US010614982B2

(12) United States Patent
Sato et al.

(10) Patent No.: US 10,614,982 B2
(45) Date of Patent: Apr. 7, 2020

(54) CIRCUIT CLOSER AND CIRCUIT CLOSING SYSTEM

(71) Applicant: Mitsubishi Electric Corporation, Chiyoda-ku (JP)

(72) Inventors: Motohiro Sato, Chiyoda-ku (JP); Katsuhiko Horinouchi, Chiyoda-ku (JP); Sho Tokoyoda, Chiyoda-ku (JP); Daisuke Fujita, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 408 days.

(21) Appl. No.: 15/521,710

(22) PCT Filed: Aug. 5, 2015

(86) PCT No.: PCT/JP2015/072190
§ 371 (c)(1),
(2) Date: Apr. 25, 2017

(87) PCT Pub. No.: WO2016/088405
PCT Pub. Date: Jun. 9, 2016

(65) Prior Publication Data

US 2017/0250040 A1 Aug. 31, 2017

(30) Foreign Application Priority Data

Dec. 1, 2014 (JP) ..... 2014-242745

(51) Int. Cl.
*H01H 33/664* (2006.01)
*H01H 33/666* (2006.01)
*H01T 4/00* (2006.01)

(52) U.S. Cl.
CPC ..... *H01H 33/664* (2013.01); *H01H 33/666* (2013.01); *H01T 4/00* (2013.01)

(58) Field of Classification Search
CPC .... H01H 33/66; H01H 33/664; H01H 33/666; H01T 1/20; H01T 1/22; H01T 4/00
(Continued)

(56) References Cited

U.S. PATENT DOCUMENTS 3,384,772 A * 5/1968 Rabinowitz ..... H01T 1/22 313/147
3,489,873 A * 1/1970 Sofianek ..... H01H 33/664 218/126
(Continued)

FOREIGN PATENT DOCUMENTS

EP 1 005 058 A2 5/2000
JP 56-28485 A 3/1981
(Continued)

OTHER PUBLICATIONS

European Office Action dated Oct. 2, 2018 in European Patent Application No. 15 864 830.3, 5 pages.
(Continued)

*Primary Examiner* — William A Bolton
(74) *Attorney, Agent, or Firm* — Oblon, McClelland, Maier & Neustadt, L.L.P.

(57) ABSTRACT

A circuit closer includes: a vacuum interrupter in which one of a pair of electrodes oppositely disposed in a vacuum vessel, wherein a gap d between the pair of electrodes always satisfies d>0, and a gap d1 between the pair of electrodes in a state in which closing of a circuit is completed, is shorter than a distance d2 at which insulation between the pair of electrodes is broken down by a charge voltage V of the circuit that is to be closed, and is longer than a distance d3 at which the pair of electrodes are bridged by a deposition of an electrode metal after a closing operation, the deposition resulting from evaporation caused by heat of an arc generated when the circuit is closed.

9 Claims, 8 Drawing Sheets

(58) Field of Classification Search
USPC ..... 218/118, 123, 130, 146
See application file for complete search history.

(56) References Cited

U.S. PATENT DOCUMENTS

| | | | | |
|---|---|---|---|---|
| 3,548,256 | A | 12/1970 | Barkan P et al. | |
| 3,632,928 | A * | 1/1972 | Emmerich | H01H 33/664 218/123 |
| 4,736,078 | A * | 4/1988 | Yasuoka | H01H 1/0206 148/22 |
| 6,326,573 | B1 * | 12/2001 | Falkingham | H01H 1/0203 218/123 |
| 2014/0307350 | A1 | 10/2014 | Shea et al. | |

FOREIGN PATENT DOCUMENTS

| | | | |
|---|---|---|---|
| JP | 1-102823 | A | 4/1989 |
| JP | 1-186780 | A | 7/1989 |
| JP | 3-110729 | A | 5/1991 |
| JP | 4-111181 | U | 9/1992 |
| JP | 8-264082 | A | 10/1996 |
| JP | 11-8043 | A | 1/1999 |
| JP | 2000-164084 | A | 6/2000 |
| JP | 2002-93294 | A | 3/2002 |

OTHER PUBLICATIONS

International Search Report dated Nov. 2, 2015 in PCT/JP2015/072190 filed Aug. 5, 2015.

Shinji Sato, et al., "Electrode Area Effect on Breakdown Field Strength of Vacuum Gaps under Non-Uniform Field" IEEJ Trans. FM, vol. 124, No. 8, 2004, pp. 747-753.

Hanna Mościcka-Grzesiak, et al., "Estimation of Properties of Contact Materials Used in Vacuum Interrupters Based on Investigations of the Microdischarge Phenomenon" IEEE Transactions on Components, Packaging, and Manufacturing Technology—Part A, vol. 18, No. 2, Jun. 1995, pp. 344-347.

* cited by examiner (CITED FROM NON-PATENT DOCUMENT 1)

AREA (S90) UP TO 90% OF MAXIMUM ELECTRIC FIELD ON CATHODE (CITED FROM NON-PATENT DOCUMENT 2)

WAVEFORM OF VOLTAGE APPLIED BETWEEN ELECTRODES OF CIRCUIT CLOSER 100

WAVEFORM OF VOLTAGE APPLIED TO SECOND CIRCUIT CLOSER 200 ADJACENT TO FIRST CIRCUIT CLOSER 100

CIRCUIT CLOSER AND CIRCUIT CLOSING SYSTEM

TECHNICAL FIELD

The present invention relates to a circuit closer (also referred to as a circuit closing device) and a circuit closing system, which are used in a power distribution grid or the like, for connecting a charged capacitor or a power supply to another circuit.

BACKGROUND ART

As a conventional technique, a configuration of a self discharge-type circuit closer is disclosed in which when the voltage between a pair of electrodes reaches a dielectric breakdown voltage in a circuit including a charged capacitor or the like, the electrodes are short-circuited to close the circuit (e.g., see Patent Document 1).

Another configuration is disclosed in which the contact elements of a pair of electrodes disposed in a vacuum vessel are brought into contact with each other to bring the electrodes into a conduction state (e.g., see Patent Document 2).

Further, as a circuit closer using a vacuum interrupter as with the aforementioned configuration, a configuration of a pulse-type circuit closer is disclosed in which: a pair of main electrodes is oppositely disposed in a vacuum vessel; a high voltage is applied to a trigger electrode provided in proximity to one or both of the main electrodes, to cause a micro-discharge between the trigger electrode and the electrode(s); and the plasma generated by the micro-discharge is injected into the main electrode(s) to break down the insulation between the main electrodes and to generate an arc, thus bringing the main electrodes into a conduction state (e.g., see Patent Document 3).

In addition, vacuum gap breakdown characteristics in the case of using oxygen-free copper as the electrode material are disclosed (Non-Patent Document 1, cited as FIG. 6 in the accompanying drawings of the present application). Dielectric breakdown voltages in the case of using different electrode materials are also disclosed (Non-Patent Document 2, cited as FIG. 7 in the accompanying drawings of the present application).

CITATION LIST

Patent Document

Patent Document 1: Japanese Laid-Open Patent Publication No. 11-8043 (pages 4 and 5, FIGS. 1 to 3)

Patent Document 2: Japanese Laid-Open Patent Publication No. 8-264082 (pages 4 and 5, FIGS. 1 to 4)

Patent Document 3: Japanese Laid-Open Patent Publication No. 1-186780 (see pages 3 and 4, FIGS. 1 and 2)

Non-Patent Document 1: Shinji Sato, Kenichi Koyama, "Electrode Area Effect on Breakdown Field Strength of Vacuum Gaps under Non-Uniform Field", The Transactions of The Institute of Electrical Engineers of Japan, A, vol. 124, issue 8, page 752, 2004

Non-Patent Document 2: Moscik-Grzesiak, H et al., "Estimation of properties of contact materials used in vacuum interrupters based on investigations of the microdischarge phenomenon", IEEE Transaction on Components, Materials and Packaging-Part A, vol. 18, pages 344-347, June 1995

SUMMARY OF THE INVENTION

Problems to be Solved by the Invention

A circuit closer as disclosed in Patent Document 1 is a closer for closing a circuit by applying a voltage between two electrodes disposed in advance with such a distance therebetween that causes a dielectric breakdown at a predetermined voltage, thereby causing a discharge therebetween. The operation device for the movable-side electrode of the closer is provided for the purpose of finely adjusting the electrode interval before application of the voltage in order for the dielectric breakdown voltage, which is changed by a change in the surface state of the electrodes caused by the above-described discharge, to be suppressed within a predetermined range. Therefore, the circuit closer is not suited for the purpose of closing a circuit including a pre-charged capacitor, reactor, or the like, and also has a feasibility problem.

Meanwhile, it is known that vacuum spacing generally has a high dielectric breakdown field property of 20 kV/mm when there are no irregularities such as sharp projections in the electrode surface state. A circuit closer using a vacuum interrupter uses the high dielectric strength of vacuum and thus can withstand a higher applied voltage at a short inter-electrode distance as compared with the case where the air or an insulation gas such as $SF_6$ gas is used. However, it is known that the insulation performance in vacuum is strongly dependent on the surface state of the electrodes. For example, when a sharp projection is formed on the surface of the cathode, electron emission due to electric field concentration occurs at the tip of the projection, and the high current density results in a significantly high temperature to melt and evaporate the electrode, causing a dielectric breakdown due to the reduced insulation performance between the electrodes, which leads to a discharge. One example of the causes of formation of sharp projections on the electrode surface is that a welded portion formed during contact between the electrodes is forcefully separated during dissociation.

In the case of a circuit closer as disclosed in Patent Document 2, when a closing operation is performed with a voltage being applied between the electrodes, an arc is generated at a point of time when the dielectric strength of the vacuum gap between the main electrodes has become unable to withstand the applied voltage, and subsequently, the main electrodes come into contact with each other. When the main electrodes are opened in this state in order to prepare for the next closing operation, projections are formed on the electrode surface as a result of the welded portion being forcefully separated, resulting in the problem that the insulation performance, between the electrodes in a steady state in which the circuit is opened by the above-described mechanism, is significantly reduced, so that the circuit cannot be favorably opened in a steady state.

In the case of a pulse-type circuit closer as disclosed in Patent Document 3, the circuit is opened by short-circuiting the electrodes with an arc without bringing the main electrodes into contact with each other, so that the above-described projections will not be formed on the surface of the main electrodes. However, in order to cause a discharge between the trigger electrode and the main electrodes at the time of closing the circuit, it is necessary to bring the tip of the trigger electrode into a high electric field state, and therefore, the diameter of the trigger electrode inevitably becomes smaller. This has resulted in the problem of increased erosion amount and reduced number of possible operations of the trigger electrode during the closing operation. In addition, a pulsed power supply for applying a voltage to the trigger electrode for causing a discharge between the trigger electrode and the main electrodes is required, and frequent maintenance work is necessary for the pulsed power supply, which is a precision device, in order to keep the performance favorable for a long period of time.

The present invention has been made in order to solve the above-described problems, and it is an object of the invention to obtain a circuit closer and a circuit closing system that: are capable of closing a pre-charged circuit by a closing operation of causing one electrode to approach the other electrode; do not cause formation of projections, which may reduce the voltage withstanding performance between the electrodes, on the surface of the electrodes even after closing the circuit by the closing operation; offer a larger number of possible operations than a pulse-type circuit closer; and do not require a trigger electrode or a pulsed power supply.

Solution to the Problems

A circuit closer according to the present invention includes: a vacuum interrupter in which one of a pair of electrodes oppositely disposed in a vacuum vessel is provided so as to be capable of advancing and retracting relative to the other of the electrodes; and an operation device for driving the one of the electrodes toward the other of the electrodes at a predetermined time, wherein a gap d between the pair of electrodes always satisfies d>0, and a gap d1 between the pair of electrodes in a state in which closing of a circuit is completed, is shorter than a distance d2 at which insulation between the pair of electrodes is broken down by a charge voltage V of the circuit that is to be closed, and is longer than a distance d3 at which the pair of electrodes are bridged by a deposition of an electrode metal forming the pair of electrodes after a closing operation, the deposition resulting from evaporation caused by heat of an arc generated when the circuit is closed.

Effect of the Invention

According to the present invention, the pair of electrodes oppositely disposed are caused to approach each other, and thereby, the insulation between the electrodes is broken down by the charge voltage of the circuit so as to generate an arc, thus bringing the electrodes into a conduction state. Accordingly, it is possible to achieve both an increased number of operations and a suppressed maintenance frequency, without needing a trigger electrode and a pulsed power supply. Further, since the electrodes will not come into contact each other after start of discharge, projections caused by welding of the electrodes will not be formed on the surface of the electrodes at the time of returning the positions of the electrodes to the circuit opening positions, making it possible to keep the insulation performance between the electrodes in a steady state favorable.

DESCRIPTION OF EMBODIMENTS

Embodiment 1

Figure 1:
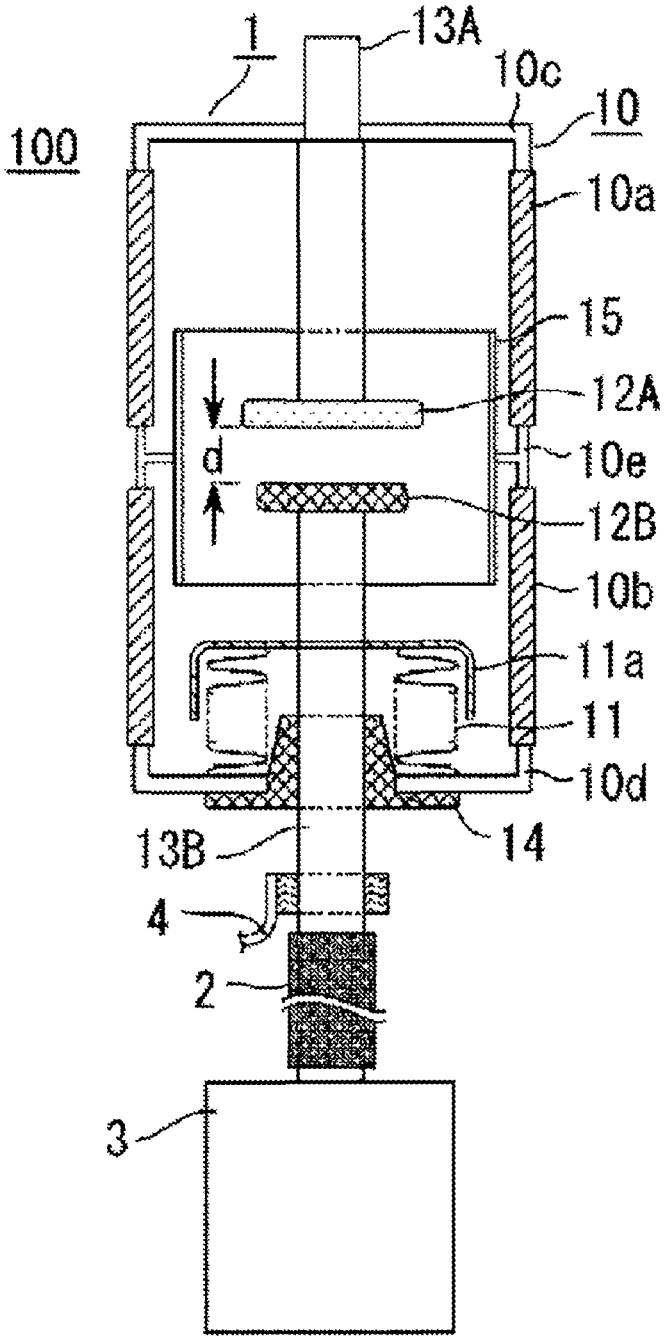
FIG. 1 is a configuration diagram schematically showing a circuit closer according to Embodiment 1 of the present invention.
Figure 2:
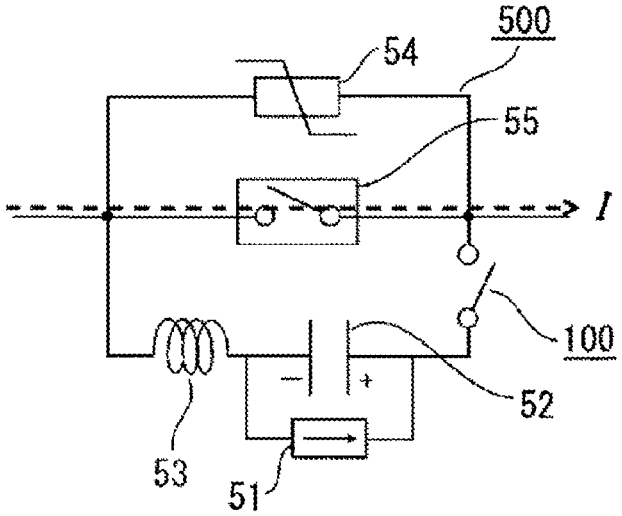
FIG. 2 is a circuit diagram schematically showing a DC current breaker using the circuit closer shown in FIG. 1.

FIG. 1 is a configuration diagram schematically showing a circuit closer according to Embodiment 1 of the present invention. FIG. 2 is a circuit diagram schematically showing the configuration of a DC current breaker using the circuit closer shown in FIG. 1. In FIG. 1, a circuit closer 100 includes a vacuum interrupter 1*a* including, in a vacuum vessel 10 configured such that outer end portions, in the axial direction, of a fixed-side insulating cylinder 10*a* and a movable-side insulating cylinder 10*b* that are coaxially disposed are covered by a fixed-side end plate 10*c* and a movable-side end plate 10*d*, respectively, and the central portion is closed by an arc shield support portion 10*e*: a fixed electrode 12A and a movable electrode 12B that are oppositely disposed; a fixed current-carrying shaft 13A having one end connected to the fixed electrode 12A and another end air-tightly penetrating the fixed-side end plate 10*c* and being fixed at the penetrating portion; and a movable current-carrying shaft 13B having one end portion fixed to the movable electrode 12B and another end portion extended out of the vacuum vessel 10 so as to be movable in the axial direction while maintaining air-tightness via a bellows 11. The circuit closer 100 also includes an operation device 3 that is connected to the other end portion of the movable current-carrying shaft 13B via an insulating rod 2 and drives the movable electrode 12B in the axial direction.

One end portion (the upper end portion in FIG. 1) of the bellows 11 is air-tightly fixed to the outer circumferential surface of the movable current-carrying shaft 13B via a bellows cover 11*a*, and the other end portion of the bellows 11 is air-tightly fixed to the upper surface of the movable-side end plate 10*d* in the drawing. A guide part 14 is installed in a portion of the movable-side end plate 10*d* through which the movable current-carrying shaft 13B is inserted, such that the movable current-carrying shaft 13B can smoothly advance and retract in the direction of the fixed electrode 12A. A movable conductor 4 for connecting to an external circuit is electromechanically fixed to a portion of the movable current-carrying shaft 13B that is guided to the outside of the vacuum vessel 10. An arc shield 15 that is formed in a cylindrical shape is attached to the arc shield support portion 10*e* so as to surround the fixed electrode 12A and the movable electrode 12B that are opposed. Here, the gap between the fixed electrode 12A and the movable electrode 12B, which are a pair of opposing electrodes, is represented as d.

The circuit diagram in FIG. 2 shows the configuration of a commonly used breaker, which is used for a power distribution grid, for interrupting the DC current flowing though the distribution grid in case of accidents. In FIG. 2, a breaker 500 has a configuration in which a charging circuit including a capacitor 52 charged by a DC power supply 51, a reactor 53 and a circuit closer 100, as well as an arrester 54 are connected in parallel with a circuit breaker 55.

When interrupting a DC current I flowing through the circuit breaker 55 shown in the drawing, the breaker 500 configured as shown in FIG. 2 passes a current in a direction reverse to the direction of the DC current I from the pre-charged capacitor 52 to the circuit breaker 55 through the reactor 53 by closing the circuit closer 100, thus forming a current-zero point.

Accordingly, the circuit closer 100 constituting the breaker 500 for interrupting the DC current needs to have performance of opening the charging circuit favorably in a steady state by insulating the voltage applied between the electrodes thereof, and closing the charging circuit when interrupting.

The circuit closer 100 of Embodiment 1 satisfies the above-described required basic performance, and a typical feature thereof is that the movable current-carrying shaft 13B can move the position of the movable electrode 12B fixed at its one end portion from a circuit opening position to a circuit closing position, but does not come into contact with the fixed electrode 12A (d=0) throughout the entire process from the circuit opening position to the completion of closing. That is, the inter-electrode gap d between the fixed electrode 12A and the movable electrode 12B always satisfies d>0, and the gap d1 between the two electrodes in a state in which closing of a circuit is completed is configured: to be shorter than a distance d2 at which insulation between the two electrodes is broken down by a charge voltage V of the circuit that is to be closed; and to be longer than a distance d3 at which the pair of electrodes are bridged by a deposition of an electrode metal, which is determined by the arc current value, the electrode diameter, the shape, and the electrode material, after a closing operation, the deposition resulting from evaporation caused by the heat of an arc generated when the circuit is closed. In the following, this will be described in further detail.

Figure 3A:
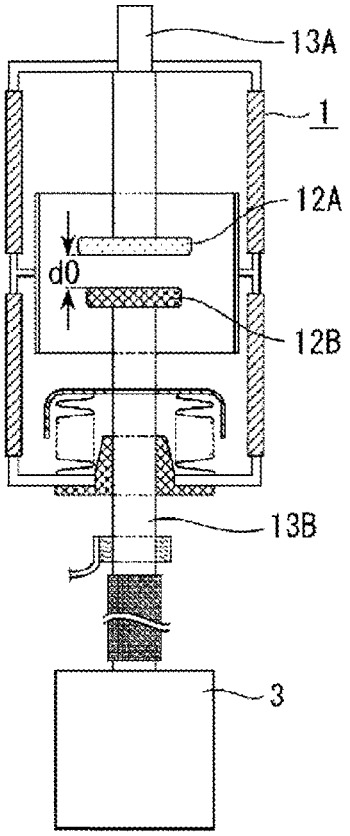
FIG. 3A is a diagram illustrating states during circuit opening of the circuit closer shown in FIG. 1.
Figure 3B:
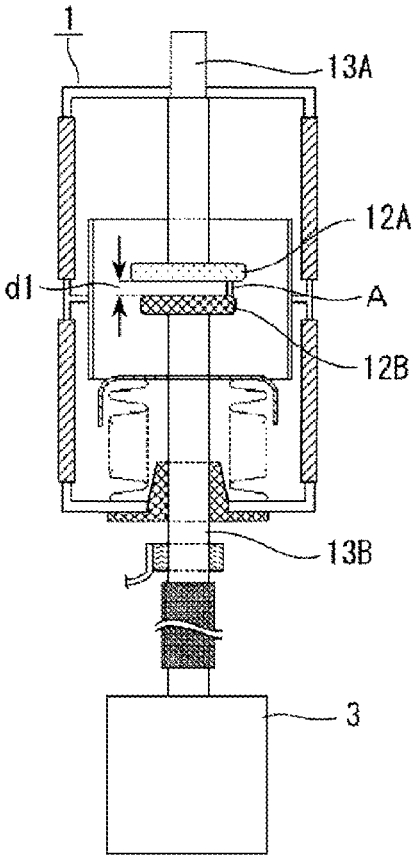
FIG. 3B is a diagram illustrating states during circuit closing of the circuit closer shown in FIG. 1.

FIGS. 3A and 3B illustrates states during circuit opening and circuit closing of the circuit closer shown in FIG. 1, wherein FIG. 3A shows the state during circuit opening and FIG. 3B shows the state during circuit closing. A distance d0 between the fixed electrode 12A and the movable electrode 12B during circuit opening shown in FIG. 3A is set to a value at which the voltage applied to the electrodes thereof can be sufficiently withstood. At the time of closing the circuit, a closing signal is transmitted from a control device (not shown) to the operation device 3 shown in FIG. 3A, and the movable electrode 12B approaches the fixed electrode 12A via the movable current-carrying shaft 13B and the insulating rod 2 by the operation device 3. The gap d1 between the fixed electrode 12A and the movable electrode 12B shown in FIG. 3B during circuit closing is set to be less than or equal to the distance d2 at which the voltage applied between the two electrodes, namely, the fixed electrode 12A and the movable electrode 12B, cannot be withstood so that the insulation between the electrodes is broken down. By doing so, an arc A is generated between the electrodes, so that the electrodes are brought into a conduction state, thus closing the circuit.

The operating speed of the circuit closer 100 needs to be determined in consideration of the mechanical strength of the bellows 11.

Figure 4:
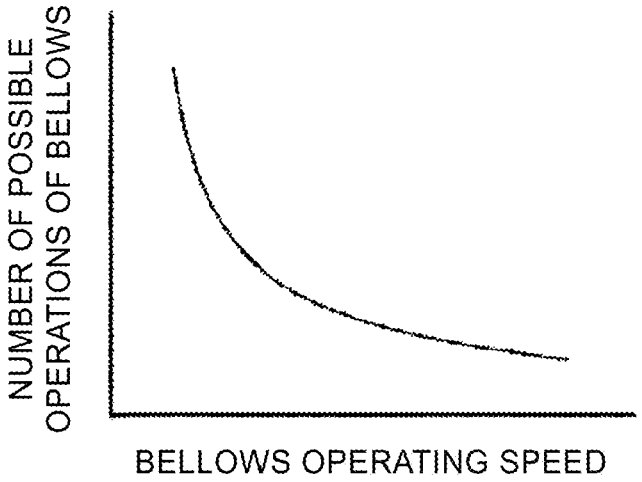
FIG. 4 is a diagram schematically showing a general relationship between the operating speed and the number of possible operations of a bellows.

FIG. 4 is a diagram schematically showing a general relationship between the operating speed and the number of possible operations of the bellows. In the drawing, the vertical axis represents the number of possible operations of the bellows, and the horizontal axis represents the operating speed of the bellows. As shown in FIG. 4, the number of possible operations of the bellows decreases with an increase in the operating speed of the bellows, and therefore, it is desirable that the circuit closer 100 is configured to perform closing at a speed that is less than or equal to an operating speed that is the limit with respect to the required number of operations.

Figure 5:
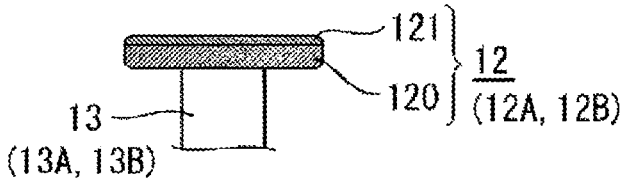
FIG. 5 is a configuration diagram of an electrode of the circuit closer shown in FIG. 1.

FIG. 5 is a configuration diagram showing an electrode of the circuit closer shown in FIG. 1. Each electrode 12 (the fixed electrode 12A or the movable electrode 12B) generates an arc in a portion facing the opposing electrode 12, and therefore is formed such that a discharge electrode layer 121 having enhanced erosion resistance is fixed to an electrode substrate 120 at the surface of the electrode 12. An end portion of the current-carrying shaft 13 (the movable current-carrying shaft 13B or the fixed current-carrying shaft 13A) is connected to the electrode substrate 120. Examples of the material that can be preferably used as the discharge electrode layer 121 include alloys of a metallic material having excellent conductivity such as copper and a metallic material having high resistance to arc corrosion such as tungsten. Examples of materials suitable for the electrode substrate 120 on the current-carrying shaft 13 side include metallic materials having excellent conductivity such as copper. The entirety of the electrode 12 shown in FIG. 5 may be formed of a material having high resistance to arc erosion.

Figure 6:
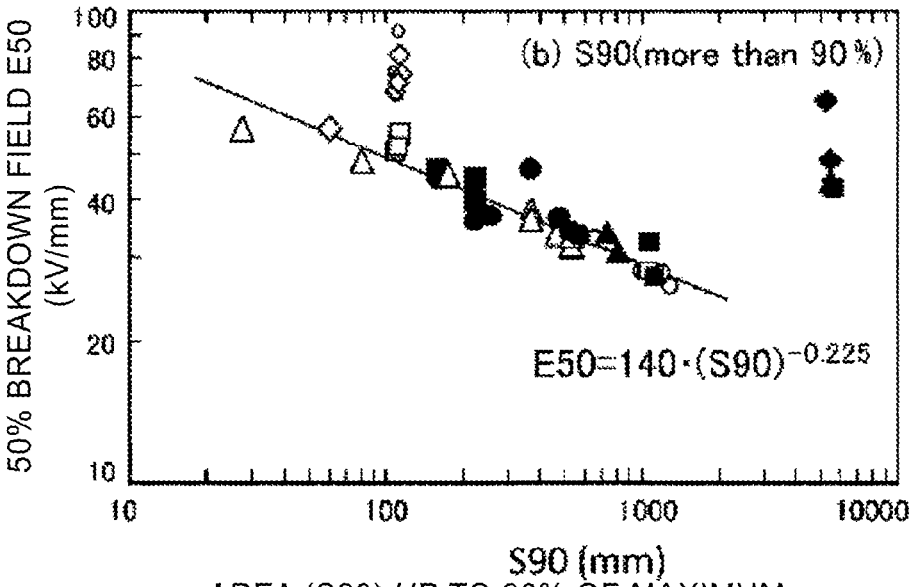
FIG. 6 is a reference diagram showing the characteristics of an electrode area effect on the dielectric breakdown field of vacuum gaps, described in Non-Patent Document 1.

FIG. 6 is a reference diagram showing the characteristics of an electrode area effect on the dielectric breakdown field of vacuum gaps, described in Non-Patent Document 1. The drawing shows the dielectric breakdown characteristics of vacuum gaps in the case of using oxygen-free copper as the electrode material. The vertical axis represents a 50% dielectric breakdown field intensity (E50), which is a median value of a Weibull distribution, and the horizontal axis represents an area (S90) up to 90% of the maximum electric field on the cathode.

The shape of the plot shown in FIG. 6 represents the difference in the electrode shape, and the drawing shows that the dielectric breakdown field E50 of the vacuum gaps in the case of using oxygen-free copper as the electrode material is not dependent on the electrode shape, but is dependent on the characteristics represented by the approximate expression: $140\times(S90)^{-0.225}$, as indicated by an approximate curve in the range in which the area (S90) up to 90% of the maximum electric field on the cathode is, for example, 200 $mm^2$ to 1000 $mm^2$. The characteristics are the same for the flat plate-shaped electrode shown in FIG. 1 and an electrode having a partly raised shape that forms a nonuniform electric field.

The above-described gap d2 at a moment when the circuit is closed as a result of the insulation between the fixed electrode 12A and the movable electrode 12B being broken down by the voltage applied between the two electrodes may be determined, for example, by using an approximate expression based on the dielectric breakdown characteristics of vacuum gaps as shown in FIG. 6. When d2 is set to be less than or equal to 5 mm, S90 may be set to 1000 $mm^2$ in a state in which the gap between the two electrodes is 5 mm, and the electric field of the portion with the maximum electric field may be set to be greater than or equal to 29.6 kV/mm.

Figure 7:
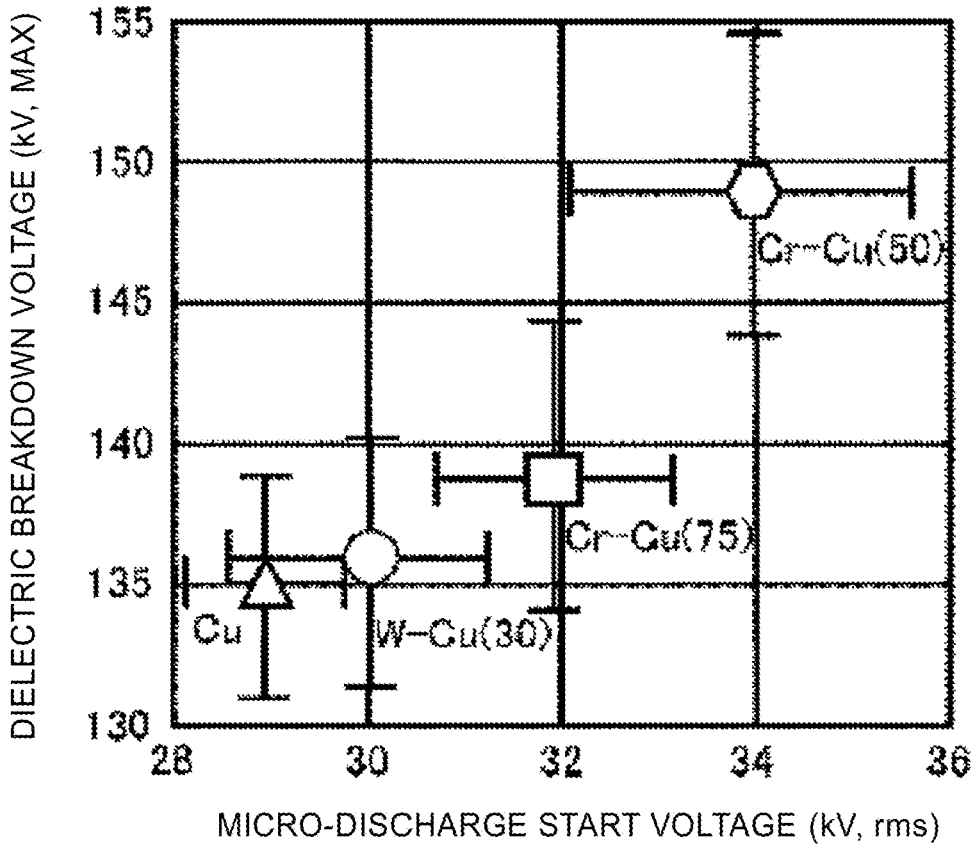
FIG. 7 is a reference diagram showing the characteristics of the dielectric breakdown voltage of vacuum gaps depending on the difference in electrode material, described in Non-Patent Document 2.

FIG. 7 is a reference diagram showing the characteristics of the dielectric breakdown voltage of vacuum gaps depending on the difference in electrode material, described in Non-Patent Document 2. In the drawing, the vertical axis represents the dielectric breakdown voltage, and the horizontal axis represents the micro-discharge start voltage. As illustrated in FIG. 7, it is known that the dielectric breakdown voltage in vacuum more or less varies depending on the electrode material. For example, the median value of the dielectric breakdown voltage of alloy W—Cu (30) of 70% tungsten and 30% copper is slightly higher than that of copper (Cu), and the difference therebetween is about 10%.

From this known fact, it is desirable that the gap d1 between the fixed electrode 12A and the movable electrode 12B that are caused to approach each other during circuit closing is determined by the following procedures 1) to 4).

1) The gap d2 between the fixed electrode 12A and the movable electrode 12B at which the insulation between the two electrodes is broken down by the voltage V charged in the circuit during circuit closing is determined.

2) The shapes of the fixed electrode 12A and the movable electrode 12B are designed such that the effective area (S90) of the cathode-side electrode at the gap d2 falls within the above-described range, and that the maximum electric field intensity at the electrode end portions resulting from the voltage applied between the electrodes exceeds an expected breakdown filed value E50 that is determined in consideration of the above-described difference in voltage withstanding performance depending on characteristics and materials.

3) The gap d1 is set to a distance shorter than at least d2.

4) At this time, the gap d1 is set to a distance longer than the distance d3 at which the electrodes are physically and electrically bridged when the metal at the contact point that has been evaporated by the heat of an arc generated during a dielectric breakdown is cooled and returns to a solid state after arc extinction. The distance at which the electrodes are bridged by the above-described evaporated metal varies depending on the arc current value, the electrode diameter, the shape, and the electrode material, and therefore, d3 is determined by these parameters.

In the procedure 2), utilizing the fact that the maximum electric field intensity on the surface is substantially unchanged when the curvature of the end portion in the cathode-side electrode is not changed, an outer circumferential end portion on the surface of an electrode that opposes the opposing electrode can be raised in the direction of the opposing electrode, or the central portion thereof can be recessed relative to the outer circumferential end portion, thereby increasing the effective area S90.

The advantage achieved by increasing the area S90 of the high-electric-field portion of the electrode configuration is that the dielectric breakdown field intensity E50 between the fixed electrode 12A and the movable electrode 12B can be decreased, and the gap d1 between the two electrodes when the two electrodes are closest to each other can be increased.

When the gap d1 is minute, loosening of the connecting portion between the components located between the operation device 3 and the movable electrode 12B or variations in the movable range of the operation device 3 due to machining errors or the like may cause the movable electrode 12B to move toward the fixed electrode 12A beyond the set stopping position during a closing operation, resulting in a collision between the electrodes. However, by increasing the effective area S90 and decreasing the dielectric breakdown voltage E50, the gap d1 is increased, making it possible to reduce the risk of collision.

In Embodiment 1 configured as described above, the inter-electrode gap d between the fixed electrode 12A and the movable electrode 12B always satisfies d>0 in the entire process from the circuit opening position to the completion of closing, and the gap d1 between the two electrodes in a state in which closing of the circuit is completed is configured: to be shorter than the distance d2 at which the insulation between the two electrodes is broken down by the charge voltage V of the circuit that is to be closed; and to be longer than the distance d3 at which the pair of electrodes are bridged by a deposition of metal after a closing operation. Thus, the circuit closer can: surely satisfy the required basic performance of favorably opening the charging circuit as shown in FIG. 2 in a steady state and closing the charging circuit when interrupting; operate quickly at the limit operating speed determined by the required number of operations; and also cause the movable electrode 12B to approach the fixed electrode 12A to the gap d1 determined by the above-described procedures 1) to 4), thereby breaking down the insulation between the electrodes to bring the circuit into a closed state. Accordingly, it is possible to achieve both an increased number of operations and a suppressed maintenance frequency, without needing a trigger electrode and a pulsed power supply. Furthermore, after start of discharge, the fixed electrode 12A and the movable electrode 12B do not come into contact with each other. Accordingly, projections caused by welding of the electrodes will not be formed on the electrode surface during circuit opening in a steady state, so that it is possible to keep the electrode insulation performance of the circuit closer favorable so as to maintain the open circuit state. Therefore, it is possible to achieve a significant effect of increasing the reliability of the device and also increasing the life thereof.

Embodiment 2

Figure 8:
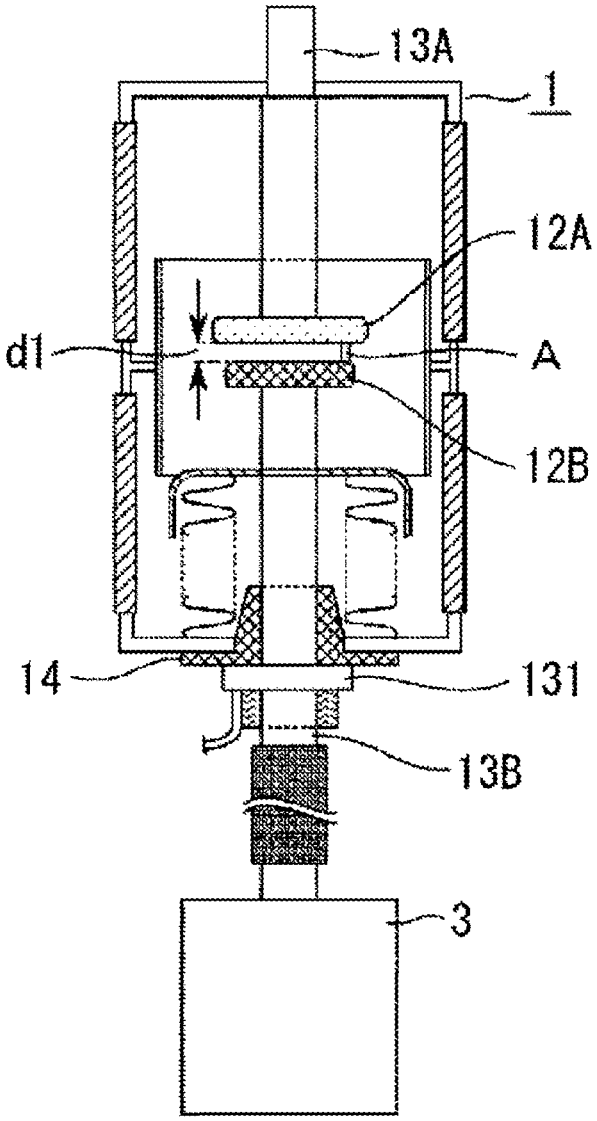
FIG. 8 is a configuration diagram schematically showing a circuit closer according to Embodiment 2 of the present invention.

FIG. 8 is a configuration diagram schematically showing a circuit closer according to Embodiment 2 of the present invention, and shows a state in which the movable electrode 12B is caused to approach the fixed electrode 12A so as to close a circuit by an arc A generated between the two electrodes. In the drawing, a movement limiting part 131 formed to have an outer diameter larger than the inner diameter of the guide part 14 is fixed to an outer circumferential portion of a part of the movable current-carrying shaft 13B that protrudes to the operation device 3 side relative to the guide part 14, so that the range of movement of the movable current-carrying shaft 13B in the direction toward the fixed electrode 12A is limited. The rest of the configuration is the same as that of Embodiment 1, and therefore, the description thereof is omitted.

In Embodiment 2 configured as described above, when the space between the fixed electrode 12A and the movable electrode 12B reaches the gap d1 determined by the above-described method during a circuit closing operation of causing the movable electrode 12B to approach the fixed electrode 12A, the movement limiting part 131 fixed to the movable current-carrying shaft 13B interferes with the lower surface of the guide part 14 in the drawing, so that the movement of the movable current-carrying shaft 13B can be instantly stopped. Here, the range of movement of the movable current-carrying shaft 13B in the direction toward the opposing fixed electrode 12A is limited by the guide part 14 and the movement limiting part 131 fixed to the movable current-carrying shaft 13B. However, various modifications may be made as long as movement limiting parts interfere with each other at any position between the movable current-carrying shaft 13B and the vacuum vessel 10 so as to limit the range of movement of the movable current-carrying shaft 13B in the direction toward the fixed electrode 12A.

As described above, according to Embodiment 2, in addition to the effect of Embodiment 1, since a predetermined portion of the movable current-carrying shaft 13B is shaped to have a thickness larger than the inner diameter of the guide part 14, even when the gap d1 between the fixed electrode 12A and the movable electrode 12B in a state in which the circuit is closed is minute, it is possible to prevent collision between the two electrodes more reliably.

Embodiment 3

Figure 9:
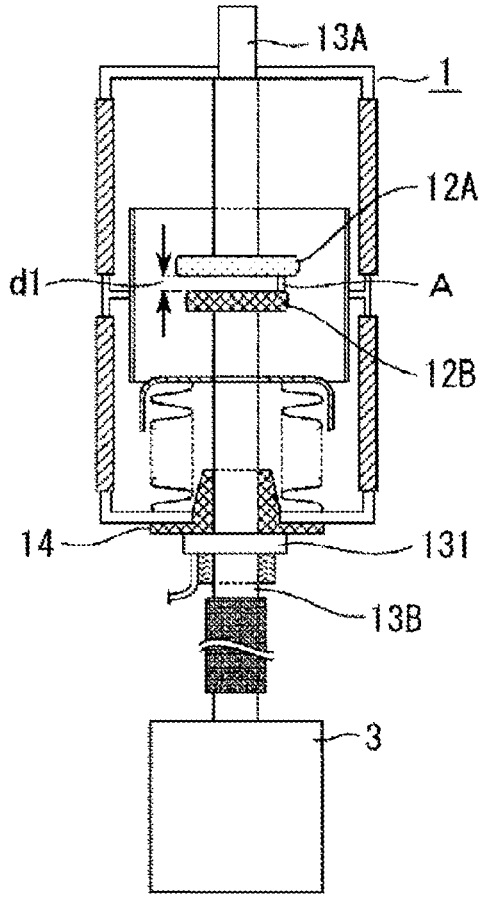
FIG. 9 is a configuration diagram schematically showing a circuit closer according to Embodiment 3 of the present invention.

FIG. 9 is a configuration diagram schematically showing a circuit closer according to Embodiment 3 of the present invention, and shows a state in which the movable electrode 12B is caused to approach the fixed electrode 12A so as to close a circuit by an arc A generated between the two electrodes. In the drawing, a stopper 16 that is made of an insulating material so as to ensure the gap d1 by colliding with an opposing side during closing of the circuit is attached to a tip portion of the movable current-carrying shaft 13B so as to penetrate and protrude from the movable electrode 12B. The rest of the configuration is the same as that of Embodiment 1.

In Embodiment 3 described as described above, the stopper 16 made of an insulating material is attached to the tip of the movable current-carrying shaft 13B so as to penetrate the movable electrode 12B. When the space between the fixed electrode 12A and the movable electrode 12B reaches the gap d1 during a circuit closing operation of causing the movable electrode 12B to approach the fixed electrode 12A, the stopper 20 collides with the fixed electrode, so that the movement of the movable electrode 12B can be instantly stopped. Accordingly, the same function and effect as those of Embodiment 1 described above can be achieved.

Since the stopper 16 is added to the configuration of Embodiment 1, even when the gap d1 between the fixed electrode 12A and the movable electrode 12B is minute, it is possible to prevent collision between the two electrodes more reliably. Even when the stopper 16 is attached to the fixed side, the same effect can be achieved. In short, the stopper 16 may be any stopper that is provided in at least one of the mover composed of the movable electrode 12B and the movable current-carrying shaft 13B and the stator composed of the fixed electrode 12A and the fixed current-carrying shaft 13A, and can ensure the gap d1 by coming into contact with an opposing side during closing of the circuit. The stopper may be attached to each of the mover and the stator, or may be provided in one of or each of the fixed electrode 12A and the movable electrode 12B.

A material that is less prone to undergo deformation or break down by an impact force generated during closing of an electrode is suitable as the material of the stopper 16, and it is desirable to use, for example, a composite material FRP having strength enhanced by including fiber such as glass fiber in the constituent resin thereof.

Embodiment 4

Figure 10:
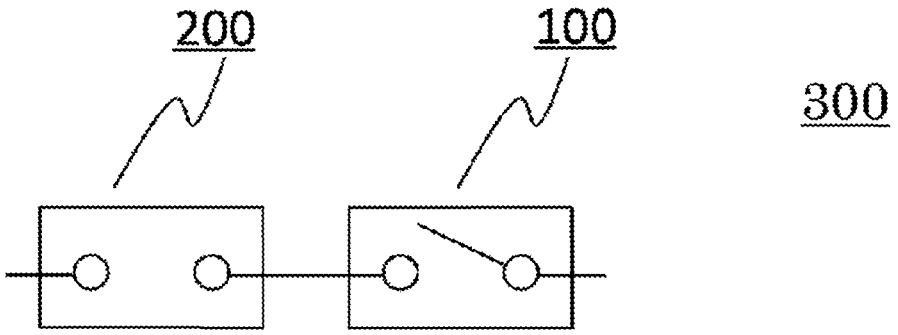
FIG. 10 is a circuit diagram schematically showing a circuit closing system according to Embodiment 4 of the present invention.

The circuit diagram shown in FIG. 10 is a circuit diagram schematically showing a circuit closing system 300 according to Embodiment 4 of the present invention. Assuming the circuit closer 100 according to Embodiments 1 to 3 as a first circuit closer, in the circuit closing system 300 of the present embodiment, a second circuit closer 200 including a pair of electrodes oppositely disposed in at least one vacuum vessel and having a fixed distance therebetween is attached in series with the first circuit closer.

Figure 11:
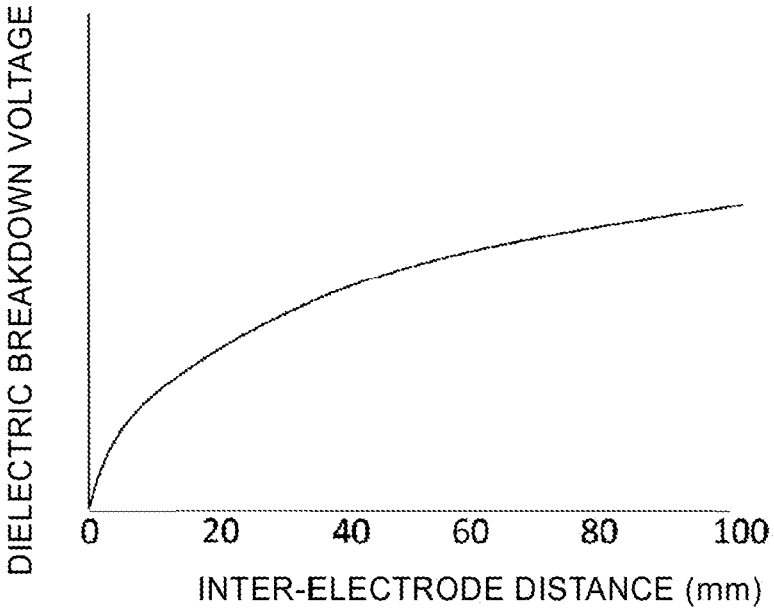
FIG. 11 is a diagram schematically showing a general relationship between the inter-electrode distance in vacuum and the dielectric breakdown voltage.

FIG. 11 is a reference diagram schematically showing the characteristics of the dielectric breakdown voltage for the inter-electrode distance in vacuum. The drawing shows that the inter-electrode distance and the dielectric breakdown voltage have a proportional relationship in a range in which the inter-electrode distance is less than or equal to 10 mm, but the dielectric breakdown voltage of vacuum gaps is not proportional to the inter-electrode distance in a range thereabove, and substantially reaches a limit value at 100 mm.

Due to such a generally well-known fact, when the charge voltage of a charging circuit using a circuit closer is high enough to be comparable with the dielectric breakdown voltage at an inter-electrode distance of 100 mm in vacuum, it may be difficult for the circuit closer described in Embodiments 1 to 3 to open the charging circuit in a steady state. Even if the circuit closer can open the charging circuit, an increase in the inter-electrode distance during circuit opening and the above-described breakdown property of the vacuum gap lead to an increased movement distance of the movable electrode 12B during circuit closing, which may result in an increase in the time for circuit closing.

In the circuit closing system 300 according to Embodiment 4 configured as described above, in order to increase the above-described dielectric breakdown voltage during circuit opening of the circuit closing system, the second circuit closer 200 having the fixed electrode interval is attached to the circuit closer described in Embodiments 1 to 3. Accordingly, by setting the dielectric breakdown voltage determined by the electrode shape, the distance between the electrodes, and the electrode material of the second circuit closer 200, to be higher than an applied voltage V1 determined by the circuit conditions in the surroundings during circuit opening, it is possible to increase and adjust the dielectric breakdown voltage of the circuit closing system 300 during circuit opening to any given value.

In order to open a charging circuit by the circuit closing system 300 according to the present embodiment, it is sufficient that the dielectric breakdown voltage determined by the electrode shape, the distance between the electrodes, and the electrode material of the second circuit closer 200 is set to be lower than a voltage V2 applied to the second circuit closer 200, which is determined by the operation of the circuit closer 100 and the circuit conditions in the surroundings when insulation between the electrodes is broken down, so that it is possible to bring the circuit closing system 300 into a conduction state simply by operating the circuit closer 100.

Desirably, resistors are connected in parallel with the circuit closer 100 and the second circuit closer 200, respectively, in the circuit closing system of Embodiment 4, in which the above-described second circuit closer 200 is connected in series with Embodiments 1 to 3, with respect to the DC voltage applied when the circuit is opened, and a capacitor is connected in parallel with each circuit closer or in parallel so as to span a plurality of the circuit closers, with respect to an AC overvoltage applied in case of a lightning strike in the surroundings of the circuit closing system, thereby taking measures to prevent dielectric breakdown caused by an unintended overvoltage being applied between the electrodes of one of the circuit closers when the circuit closer 100 is not closed.

Figure 12:
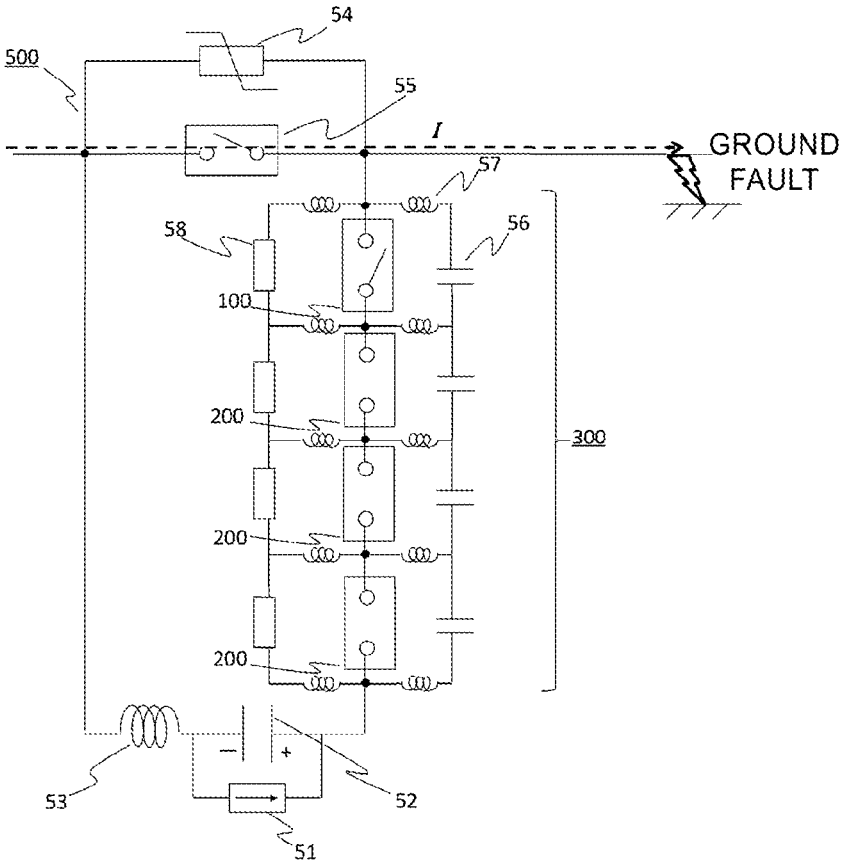
FIG. 12 is a circuit diagram schematically showing an example of the configuration of a DC current breaker using the circuit closing system according to Embodiment 4.

The circuit diagram shown in FIG. 12 is a circuit diagram schematically showing an example of the configuration of a DC breaker using the circuit closing system 300 according to Embodiment 4, including one circuit closer 100 and three second circuit closers 200. The DC breaker has a configuration in which a charging circuit including a capacitor 52 charged by a DC power supply 51, a reactor 53, the circuit closing system 300, capacitors 56 for equalizing the voltage applied when a circuit is opened, and resistors 58, as well as an arrester 54 are connected in parallel with a circuit breaker 55. An inductance component 57 in the circuit closing system 300 represents an inductance component parasitic in a wire connecting each vacuum interrupter to the capacitors. Normally, there is a parasitic inductance of about 1 μH per meter of the wire.

The above-described inductance component 57 may be adjusted to any given value by insertion of a circuit element having an inductance component, such as a reactor.

Figure 13A:
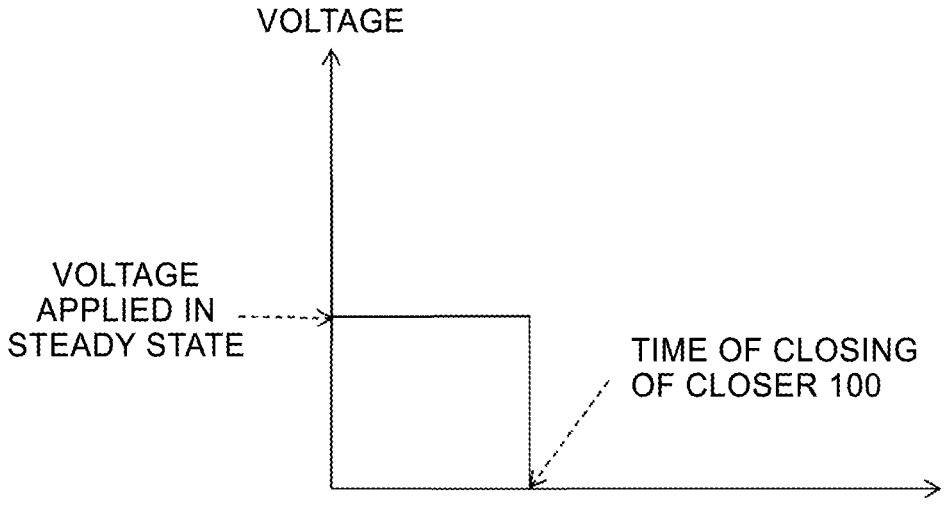
FIG. 13A is a diagram schematically showing a tendency in change in waveforms of voltages applied to vacuum interrupters during circuit closing in the circuit closing system according to Embodiment 4.
Figure 13B:
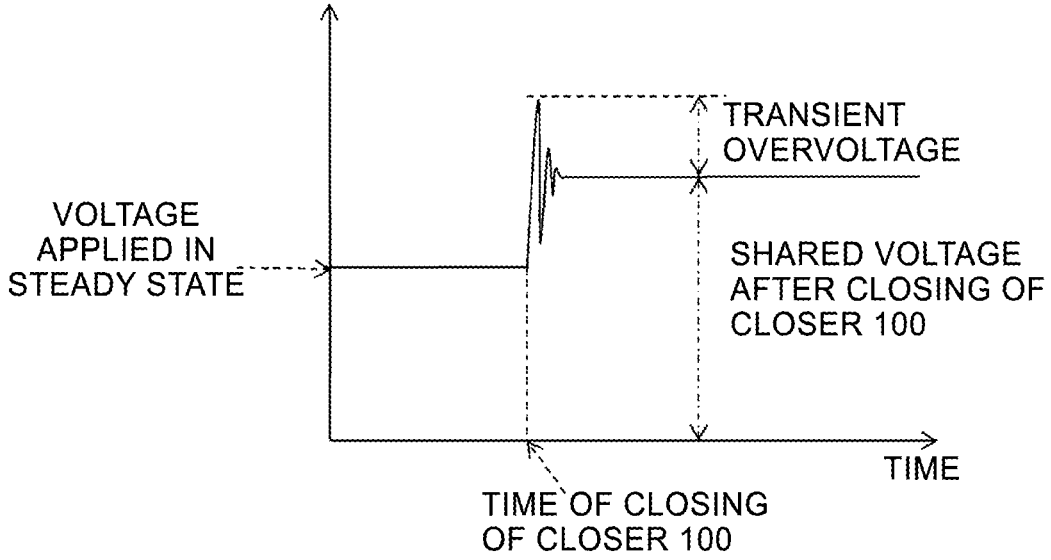
FIG. 13B is a diagram schematically showing a tendency in change in waveforms of voltages applied to vacuum interrupters during circuit closing in the circuit closing system according to Embodiment 4.

FIGS. 13A and 13B schematically shows waveforms of voltages applied between the electrodes of the circuit closer 100 when the charging circuit is closed by the circuit closing system 300 when interrupting in the DC breaker shown in FIG. 12, and between the electrodes of the second circuit closer 200 adjacent to the circuit closer 100.

In FIG. 13A, when the circuit closer 100 operates, an overvoltage is applied between the electrodes of the second circuit closer 200 adjacent to the circuit closer 100 in a transition process from the originally applied voltage to a voltage shared after closing of the circuit closer 100 as shown in FIG. 13B. The reason is as follows. Even after the electrodes of the circuit closer 100 have been brought into a conduction state, the electric charge of the capacitor 56 connected in parallel therewith is not instantaneously discharged due to the presence of the inductance components 57 in the wire. Accordingly, to the second circuit closer 200 adjacent to the circuit closer 100*a*, a combined voltage of the charge voltage of the capacitor connected in parallel therewith and the charge voltage of the capacitor connected in parallel with the circuit closer 100 is applied. The magnitude of the transient overvoltage is uniquely determined when the number of the circuit closers 100 and 200 in the circuit closing system 300, the voltage applied in a steady state, the capacitance of each capacitor 56, the value of each inductance component 57 in the wire, and the connecting location of each capacitor 56 are determined.

That is, the above-described voltage V1 is a voltage shared by the resistor 58 connected in parallel with the second circuit closer 200 when the circuit is opened, and the above-described voltage V2 is an overvoltage applied to the second circuit closer 200 immediately after the circuit closer 100 has been brought into a conduction state. Accordingly, the electrode shape, the distance between the electrodes, and the electrode material of the second circuit closer 200 may be set in consideration of the above-described V1 and V2.

In the case of applying, to the DC breaker shown in FIG. 12, the circuit closing system 300 using the second circuit closer for which the electrode shape, the distance between the electrodes and the electrode material have been determined in the above-described manner, when the circuit closer 100 is operated when interrupting, the second circuit closer 200 adjacent thereto is brought into a conduction state. Immediately thereafter, an overvoltage is applied to the second circuit closer adjacent thereto by the same circuit phenomenon as described above, thereby bringing all the connected second circuit closers 200 into a conduction state in a chain reaction manner.

As described above, the circuit closing system of Embodiment 4 can achieve the same effects as those achieved by Embodiments 1 to 3, and is also advantageous in that the circuit closing system can be applied to a high-voltage charging circuit that may be difficult to be opened in a steady state by the circuit closer of Embodiments 1 to 3, which includes a single vacuum interrupter, while the time required for circuit closing is kept substantially unchanged.

It is noted that within the scope of the present invention, part or all of the above embodiments may be freely combined with each other, or each of the above embodiments may be modified or simplified as appropriate.

DESCRIPTION OF THE REFERENCE CHARACTERS

1 vacuum interrupter
10 vacuum vessel
10*a* fixed-side insulating cylinder
10*b* movable-side insulating cylinder
10*c* fixed-side end plate
10*d* movable-side end plate
10*e* arc shield support portion
11 bellows
11*a* bellows cover
12 electrode
12A fixed electrode
12B movable electrode
120 electrode substrate
121 discharge electrode layer
13 current-carrying shaft
13A fixed current-carrying shaft
13B movable current-carrying shaft
131 movement limiting part
14 guide part
15 arc shield
16 stopper
2 insulating rod
3 operation device
4 movable conductor
51 DC power supply
52 capacitor
53 reactor
54 arrester
55 circuit breaker
56 capacitor
57 inductance component
58 resistor
100 circuit closer (first circuit closer)
200 second circuit closer
300 circuit closing system

500 breaker
A arc
d gap between pair of electrodes

The invention claimed is:

1. A circuit closer comprising:

a vacuum interrupter in which one of a pair of electrodes oppositely disposed in a vacuum vessel is provided so as to advance and retract relative to the other of the electrodes; and an operation device for driving the one of the electrodes toward the other of the electrodes at a predetermined time, wherein a gap d between the pair of electrodes always satisfies d>0, and a gap d1 between the pair of electrodes in a state in which closing of a circuit is completed, is shorter than a distance d2 at which insulation between the pair of electrodes is broken down by a charge voltage V of the circuit that is to be closed, and is longer than a distance d3 at which the pair of electrodes are bridged by a deposition of an electrode metal forming the pair of electrodes after a closing operation, the deposition resulting from evaporation caused by heat of an arc generated when the circuit is closed.

2. The circuit closer according to claim 1, wherein the distance d2 is set such that a 50% dielectric breakdown field intensity is greater than a maximum electric field intensity on a surface of one of the pair of electrodes on a cathode side when the charge voltage V is applied between the pair of electrodes, the 50% dielectric breakdown field intensity being a median value of a Weibull distribution determined by an expression obtained for an electric field range area up to 90% of the maximum electric field intensity on an electrode surface area on the cathode side.

3. The circuit closer according to claim 1, wherein an operation distance of the operation device is shorter than a gap d0 between the pair of electrodes during circuit opening.

4. The circuit closer according to claim 1, wherein a surface shape of an opposing surface of one of the pair of electrodes on a cathode side of the pair of electrodes oppositely disposed is formed such that an outer circumferential portion thereof protrudes from a center portion thereof toward the opposing electrode so as to increase the area up to 90% of the maximum electric field intensity.

5. The circuit closer according to claim 1, further comprising:

a movable current-carrying shaft having one end fixed to one of the pair of electrodes oppositely disposed and another end extended out of the vacuum vessel so as to be movable relative to the vacuum vessel while maintaining air-tightness; and a movement limiting part that is provided between the movable current-carrying shaft and the vacuum vessel, and limits a range of movement of the movable current-carrying shaft in a direction toward the other of the electrodes.

6. The circuit closer according to claim 1, further comprising:

a mover including a movable current-carrying shaft having one end portion fixed to one of the pair of electrodes oppositely disposed and another end portion extended out of the vacuum vessel so as to be movable relative to the vacuum vessel while maintaining air-tightness;

a stator including a current-carrying shaft having one end portion fixed to the other of the electrodes and another end portion extended out of the vacuum vessel; and a stopper that is provided in at least one of the mover and the stator, and is made of an insulating material so as to ensure the gap d1 by colliding with an opposing side during closing of the circuit.

7. A circuit closing system comprising:

the circuit closer according to claim 1 as a first circuit closer; and at least one second circuit closer connected to the first circuit closer, wherein the second circuit closer includes a pair of electrodes oppositely disposed in at least one vacuum vessel and having a fixed distance between the two electrodes.

8. The circuit closing system according to claim 7, wherein a dielectric breakdown voltage of the second circuit closer is set to be higher than a voltage applied to the second circuit in an open circuit state, and lower than a voltage applied to the second circuit closer in a closed circuit state in which the first circuit closer has undergone dielectric breakdown.

9. The circuit closing system according to claim 7, wherein a resistor is connected in parallel with each of the first circuit closer and the second circuit, and a capacitor is connected in parallel with each of the first circuit closer and the second circuit closer, or connected in parallel so as to span a plurality of the first circuit closer and the second circuit closers.

* * * * *